US006725667B2

(12) United States Patent
Farmer et al.

(10) Patent No.: US 6,725,667 B2
(45) Date of Patent: Apr. 27, 2004

(54) COMBUSTOR DOME FOR GAS TURBINE ENGINE

(75) Inventors: Gilbert Farmer, Cincinnati, OH (US); James Anthony Groeschen, Burlington, KY (US)

(73) Assignee: General Electric Company, Schenectady, NY (US)

( * ) Notice: Subject to any disclaimer, the term of this patent is extended or adjusted under 35 U.S.C. 154(b) by 97 days.

(21) Appl. No.: 10/225,757

(22) Filed: Aug. 22, 2002

(65) Prior Publication Data

US 2004/0035115 A1 Feb. 26, 2004

(51) Int. Cl.[7] ..... F02C 3/14
(52) U.S. Cl. ..... 60/804; 60/752
(58) Field of Search ..... 60/752, 796, 798, 60/800, 804

(56) References Cited

U.S. PATENT DOCUMENTS

| | | | | | |
|---|---|---|---|---|---|
| 3,854,285 | A | | 12/1974 | Stenger et al. | 60/39.66 |
| 3,990,232 | A | | 11/1976 | Campbell | 60/39.66 |
| 5,237,820 | A | * | 8/1993 | Kastl et al. | 60/752 |
| 5,239,832 | A | | 8/1993 | Koshoffer et al. | 60/740 |
| 5,329,761 | A | | 7/1994 | Ablett et al. | 60/39.36 |
| 5,331,815 | A | | 7/1994 | Reinhold, Jr. et al. | 60/748 |
| 6,148,600 | A | * | 11/2000 | Farmer et al. | 60/804 |
| 6,279,323 | B1 | * | 8/2001 | Monty et al. | 60/752 |
| 6,314,739 | B1 | | 11/2001 | Howell et al. | 60/748 |
| 6,438,958 | B1 | * | 8/2002 | McCaffrey et al. | 60/752 |
| 6,502,400 | B1 | * | 1/2003 | Freidauer et al. | 60/772 |
| 6,581,386 | B2 | * | 6/2003 | Young et al. | 60/798 |
| 6,655,146 | B2 | * | 12/2003 | Kutter et al. | 60/752 |
| 6,655,147 | B2 | * | 12/2003 | Farmer et al. | 60/752 |

* cited by examiner

*Primary Examiner*—Michael Koczo
(74) *Attorney, Agent, or Firm*—William Scott Andes; James P. Davidson

(57) ABSTRACT

A combustor for a gas turbine engine having a longitudinal axis extending therethrough, including an inner liner, an outer liner spaced radially from the inner liner, an annular dome connected to the inner and outer liners, a plurality of air/fuel mixers connected to the dome and circumferentially spaced within the dome, an outer cowl connected to the outer liner, and an inner cowl connected to the inner liner, wherein a combustion chamber is formed by the inner liner, the outer liner and the dome. The dome further includes a first end connected to a liner of the combustor, a second end spaced radially from the first end, a first portion extending rearwardly from the first end adjacent the liner, a second portion extending rearwardly from the second end and flaring radially outward from the longitudinal axis, and a nonlinear third portion connecting the first and second dome portions.

21 Claims, 4 Drawing Sheets

COMBUSTOR DOME FOR GAS TURBINE ENGINE

BACKGROUND OF THE INVENTION

The present invention relates generally to a combustor dome for a gas turbine engine and, in particular, to a one-piece combustor dome which connects directly to the liner and cowl of the combustor.

It is well known within the combustor art of gas turbine engines that a dome portion, in conjunction with inner and outer liners, serves to form the boundary of a combustion chamber. A mixture of fuel and air is ignited and burned in such combustion chamber so that the products thereof are able to interface with the blades of turbines and produce work through one or more shafts. The annular combustor dome also serves to position a plurality of mixers in a circumferential manner so that the fuel/air mixture is provided in a desired manner. Because of its proximity to the combustion chamber hot gases and the extreme temperatures produced therein, the dome must be configured to withstand the harsh environment.

While previous designs have disclosed connecting the dome and liner portions downstream of the dome, this subjected the connection to the hot temperatures of the combustion chamber and interrupted the flow of cooling air along the liners. Accordingly, it became preferable to locate the connection of the dome and liners, as well as the respective cowls, upstream of the dome. In a current design, an intermediate member (such as a rivet band) has been utilized to indirectly connect the dome to an adjacent liner and cowl. Moreover, the intermediate member is typically brazed to the dome and requires additional time and effort in the manufacturing cycle.

Another combustor configuration is depicted in U.S. Pat. No. 3,990,232 to Campbell, where a dome having an integral V-shaped cross section has an apex portion from which first and second legs depend. As this design is currently employed, a pair of forgings requiring two weldings each is utilized. This further complicates the manufacturing cycle and extends the time required therefor.

Thus, in light of the foregoing, it would be desirable for a combustor dome configuration to be developed which simplifies its assembly and eliminates timely and costly operations from the manufacturing cycle. It is also desirable for weight in the dome and liner sections to be reduced where possible. At the same time, the functional characteristics of the combustor are preferably maintained with the previous design, including the amount and flow of cooling air supplied, so that recertification of the engine is avoided.

BRIEF SUMMARY OF THE INVENTION

In a first exemplary embodiment of the invention, a combustor for a gas turbine engine having a longitudinal axis extending therethrough is disclosed as including an inner liner, an outer liner spaced radially from the inner liner, an annular dome connected to the inner and outer liners, a plurality of fuel/air mixers connected to the dome and circumferentially spaced within the dome, an outer cowl connected to the outer liner, and an inner cowl connected to the inner liner, wherein a combustion chamber is formed by the inner liner, the outer liner and the dome. The dome further includes a first end connected to the outer liner of the combustor, a second end spaced radially from the first dome end and connected to the inner liner of the combustor, a first portion extending rearwardly from the first end adjacent the outer liner, a second portion extending rearwardly from the second end adjacent the inner liner, a third portion extending from an inner diameter thereof and flaring radially outwardly with respect to the longitudinal axis, a fourth portion extending from an inner diameter thereof and flaring inwardly with respect to the longitudinal axis, an arcuate fifth portion connecting the first and third dome portions, and an arcuate sixth portion connecting the second and fourth dome portions.

In a second exemplary embodiment of the invention, an annular dome for a combustor of a gas turbine engine having a longitudinal axis extending therethrough is disclosed as including: a first end connected to a fuel/air mixer of the combustor; a second end connected to a liner of the combustor; a first portion extending rearwardly from the first end and flaring radially outward from the longitudinal axis; a second portion extending rearwardly from the second end adjacent the liner; and, an arcuate third portion connecting the first and second dome portions.

DETAILED DESCRIPTION OF THE INVENTION

Figure 1:
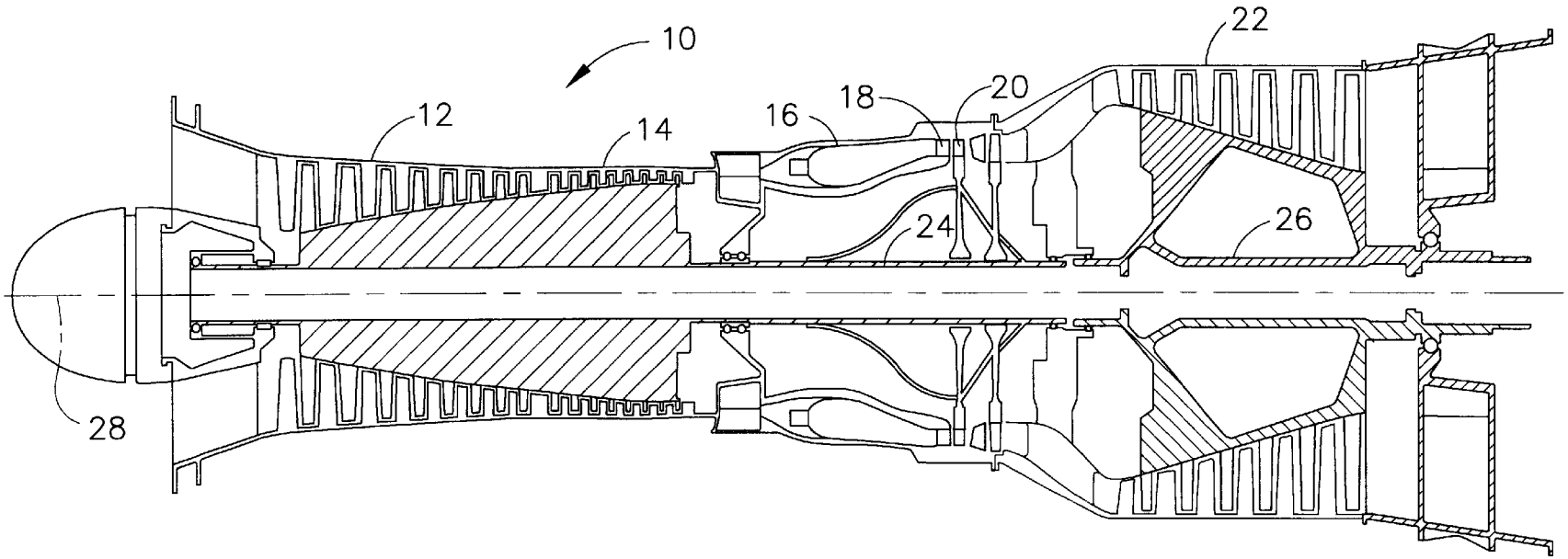
FIG. 1 is a diagrammatic cross-sectional view of a gas turbine engine including a combustor like that of the present invention.

Referring now to the drawings in detail, wherein identical numerals indicate the same elements throughout the figures, FIG. 1 depicts an exemplary gas turbine engine 10 having in serial flow communication a low pressure compressor 12, a high pressure compressor 14, and a combustor 16. Combustor 16 conventionally generates combustion gases that are discharged therefrom through a high pressure turbine nozzle assembly 18, from which the combustion gases are channeled to a conventional high pressure turbine 20 and, in turn, to a conventional low pressure turbine 22. High pressure turbine 20 drives high pressure compressor 14 through a suitable shaft 24, while low pressure turbine 22 drives low pressure compressor 12 through another suitable shaft 26, all disposed coaxially about a longitudinal or axial centerline axis 28.

Figure 2:
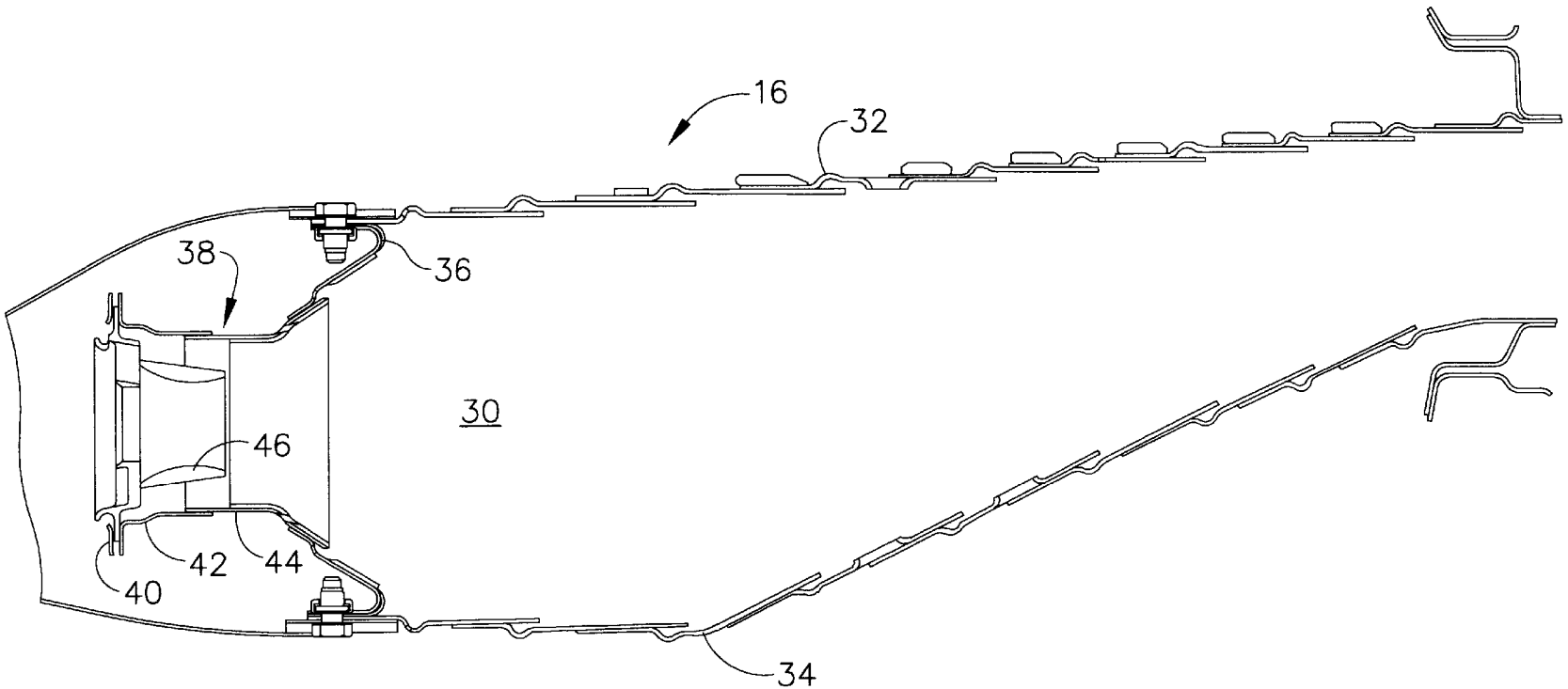
FIG. 2 is a cross-sectional view of the combustor depicted in FIG. 1 including a combustor dome in accordance with the present invention.

As seen in FIG. 2, combustor 16 further includes a combustion chamber 30 defined by an outer liner 32, an inner liner 34, and a dome 36 located at an upstream end thereof. It will be seen that a plurality of fuel/air mixers 38 are circumferentially spaced within dome 36 so as to introduce a mixture of fuel and air into combustion chamber 30, where it is ignited by an igniter (not shown) and combustion gases are formed which are utilized to drive high pressure turbine 20 and low pressure turbine 22, respectively. More specifically, air/fuel mixers 38 include a ferrule retainer 40, a ferrule flange 42, a deflector plate 44, and a swirler 46. It is preferred that ferrule flange 42 and deflector plate 44 be connected directly, such as by brazing, so as to eliminate the need for a cup insert positioned therebetween.

Figure 3:
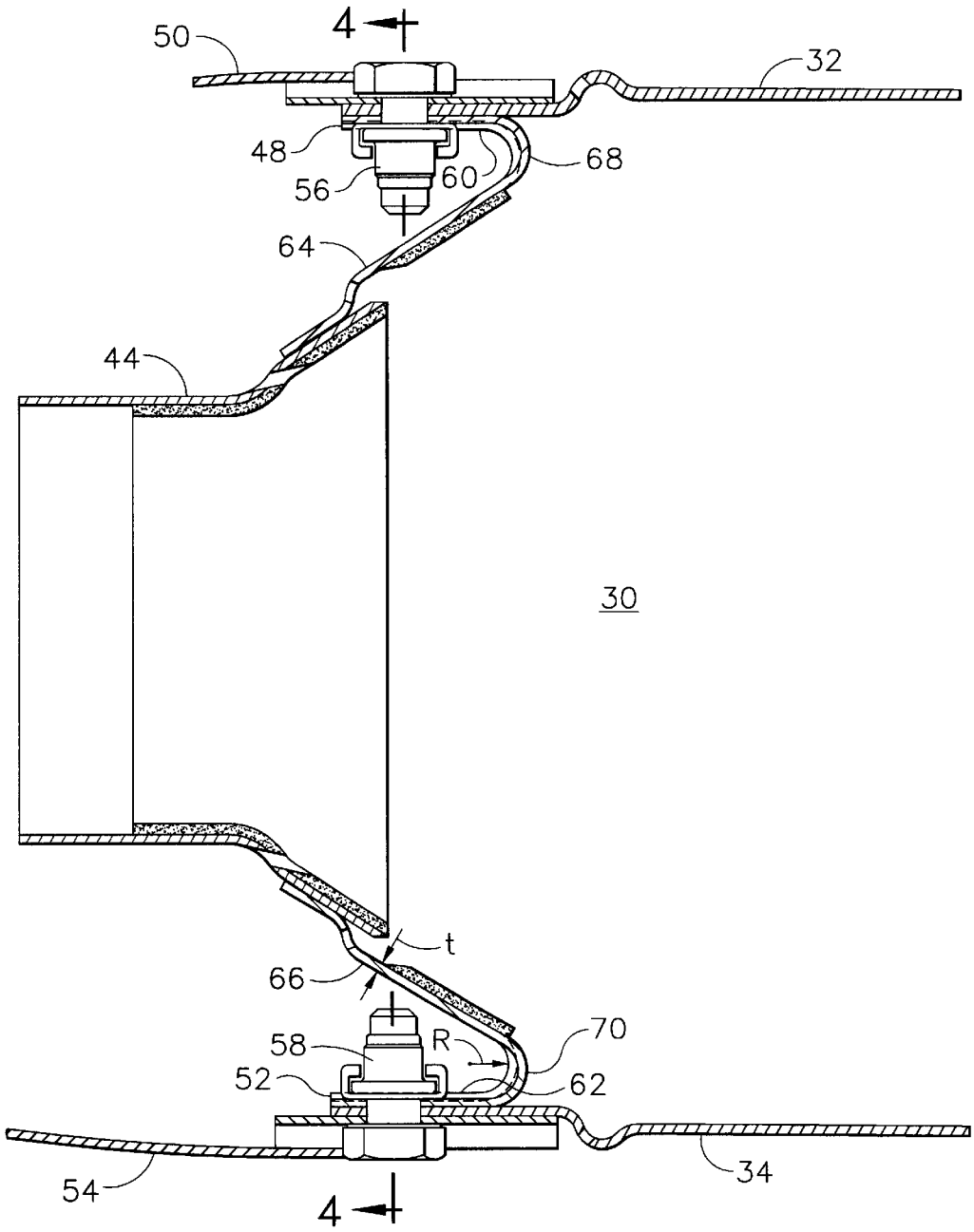
FIG. 3 is an enlarged, partial sectional view of the combustor depicted in FIG. 2; and, FIG. 4 is a partial aft looking forward view of the combustor depicted in FIGS. 2 and 3 taken along line 4—4 of FIG. 3, where the fuel/air mixers have been omitted for clarity.
Figure 4:
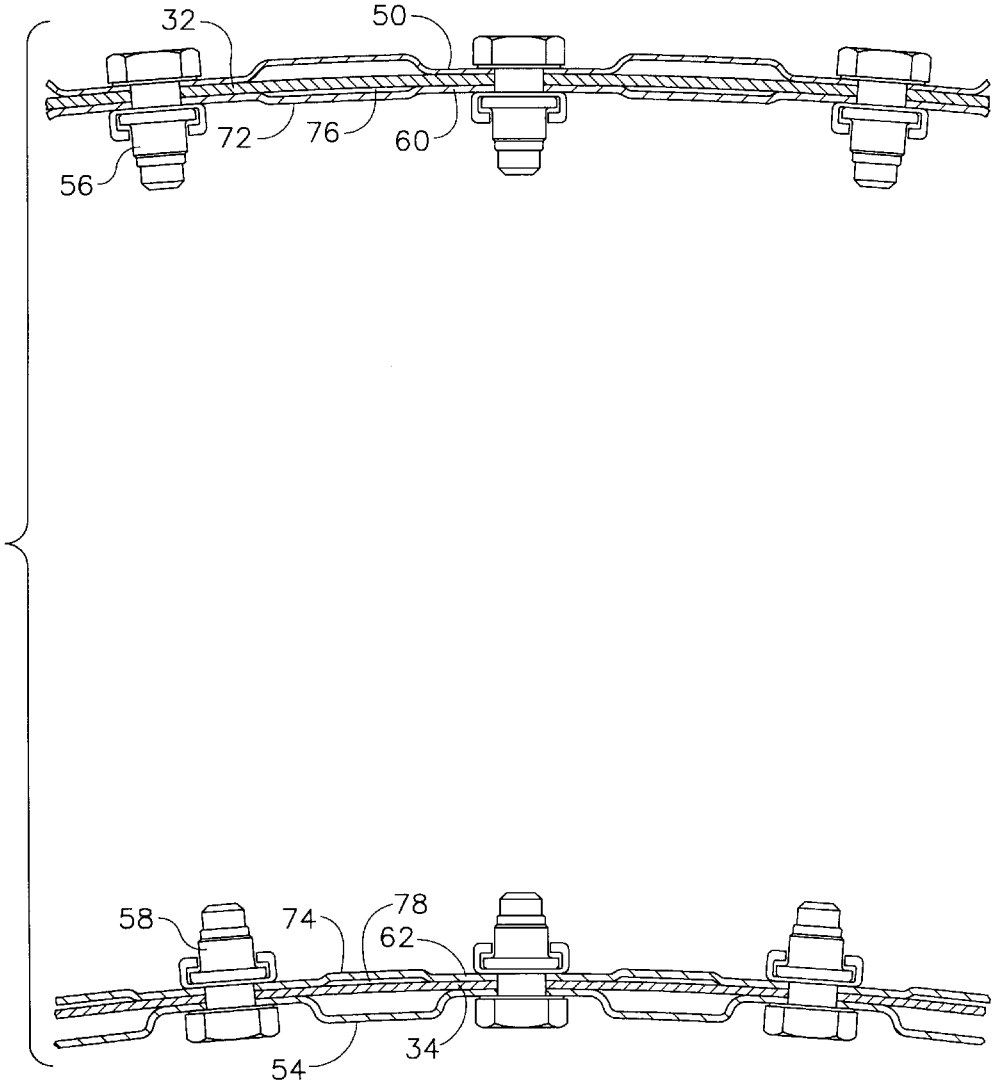

In accordance with the present invention, it will be noted from FIGS. 2–4 that dome 36 preferably is annular and includes a first end 48 located about an outer diameter of dome 36. First end 48 is preferably connected to outer liner 32 and an outer cowl 50 in a manner described in greater detail herein. Dome 36 further includes a second end 52 located radially inward from first dome end 48 about an inner diameter of dome 36, where second end 52 is preferably connected to inner liner 34 and an inner cowl 54 similar to that for first dome end 48, outer liner 32 and outer cowl 50. More specifically, it will be seen that a first connector 56 connects together first dome end 48, outer liner 32 and outer cowl 50 as plies when aligned properly. Likewise, a second connector 58 connects together second dome end 52, inner liner 34 and inner cowl 54 as plies when brought into alignment.

Dome 36 preferably includes a first portion 60 extending rearwardly (i.e., toward combustion chamber 30) from first dome end 48 adjacent outer liner 32 and a second portion 62 extending rearwardly from second dome end 52 adjacent inner liner 34. It will be appreciated that dome 36 further includes a third dome portion 64 and a fourth dome portion 66 which preferably are connected to deflector plate 44 and flare radially outward and inward, respectively, from fuel/air mixers 38 and longitudinal axis 28. A fifth dome portion 68 is provided to connect first dome portion 60 and third dome portion 64, where fifth dome portion 68 is nonlinear to accommodate the angular relationship between first and third dome portions 56 and 64. Similarly, a sixth dome portion 70 is provided to connect second dome portion 62 and fourth dome portion 66, where sixth dome portion 70 is nonlinear to accommodate the angular relationship between second and fourth dome portions 58 and 66.

It will be understood that fifth and sixth dome portions 68 and 70, respectively, are preferably arcuate in cross-section so as to have a designated radius R to better withstand the rigors of the combustor environment. Radius R of fifth and sixth dome portions 68 and 70 is a function of a thickness t for dome 36, where radius R is preferably at least twice thickness t and optimally approximately 3–5 times thickness t. In the current configuration, thickness t of combustor dome 36 is preferably in a range of approximately 0.030–0.038 inches, so radius R of fifth and sixth dome portions 68 and 70 is preferably in a range of approximately 0.060–0.120 inches.

In order to maintain the operating characteristics of combustor 16 compared to the previous design, dome 36 preferably includes a plurality of circumferentially spaced corrugations 72 and 74 formed in the outer and inner diameters thereof. Each corrugation 72 provides an opening 76 between dome 36 and outer liner 32, while each corrugation 74 provides an opening 78 between dome 36 and inner liner 34, so that cooling air is permitted to flow therethrough. It will be seen that corrugations 72 and 74 are generally in a trapezoidal shape when viewed in FIG. 4, although they may be any shape so as to permit a desired amount of air flow.

It will be understood that dome 36 is preferably a one-piece construction and made of sheet metal, although other similar materials may be utilized.

Having shown and described the preferred embodiment of the present invention, further adaptations of the combustor and the dome thereof can be accomplished by appropriate modifications by one of ordinary skill in the art without departing from the scope of the invention.

What is claimed is:

1. A combustor for a gas turbine engine having a longitudinal axis extending therethrough, comprising:

(a) an inner liner;

(b) an outer liner spaced radially from said inner liner;

(c) an annular dome connected to said inner and outer liners said dome further comprising:

(1) a first end connected to said outer liner of said combustor;

(2) a second end spaced radially from said first end and connected to said inner liner of said combustor;

(3) a first portion extending rearwardly from said first end adjacent said outer liner;

(4) a second portion extending rearwardly from said second end adjacent said inner liner;

(5) a third portion extending from an inner diameter thereof and flaring radially outwardly with respect to said longitudinal axis;

(6) a fourth portion extending from an inner diameter thereof and flaring radially inwardly with respect to said longitudinal axis;

(7) an arcuate fifth portion connecting said first and third dome portions, wherein said fifth dome portion has a designated radius which is a function of a thickness for said combustor dome; and (8) an arcuate sixth portion connecting said second and fourth dome portions, wherein said sixth dome portion has a designated radius which is a function of a thickness for said combustor dome;

(d) a plurality of air/fuel mixers connected to said second dome end and circumferentially spaced within said dome;

(e) an outer cowl connected to said outer liner; and (f) an inner cowl connected to said inner liner;

wherein a combustion chamber is defined by said inner liner, said outer liner and said dome.

2. The combustor of claim 1, wherein said combustor is a single annular combustor.

3. The combustor of claim 1, wherein said combustor dome is formed of a single piece of sheet metal.

4. The combustor of claim 1, wherein said designated radius of said fifth and sixth dome portions is at least twice the thickness of said combustor dome.

5. The combustor of claim 1, wherein said designated radius of said fifth and sixth dome portions is approximately 3–5 times the thickness of said combustor dome.

6. The combustor of claim 1, further comprising a plurality of circumferentially spaced corrugations formed in said first dome portion.

7. The combustor of claim 1, further comprising a plurality of circumferentially spaced corrugations formed in said second dome portion.

8. The combustor of claim 6, wherein an opening is formed between each corrugation and said outer liner to permit air to flow therethrough.

9. The combustor of claim 7, wherein an opening is formed between each corrugation and said inner liner to permit air to flow therethrough.

10. The combustor of claim 1, wherein said first dome end is connected to said outer liner in a position forward of said fifth dome portion.

11. The combustor of claim 1, wherein said second dome end is connected to said inner liner in a position forward of said sixth dome portion.

12. An annular dome for a combustor of a gas turbine engine having a longitudinal axis extending therethrough, comprising:

(a) a first end connected to a fuel/air mixer of said combustor;

(b) a second end connected to a liner of said combustor;

(c) a first portion extending rearwardly from said first end and flaring radially outward from said longitudinal axis;

(d) a second portion extending rearwardly from said second end adjacent said liner, wherein a plurality of circumferentially spaced corrugations are formed therein; and (e) an arcuate third portion connecting said first and second dome portions.

13. The combustor dome of claim 12, wherein said combustor dome is formed of a single piece of sheet metal.

14. The combustor dome of claim 12, wherein said second end of said combustor dome is connected to an inner liner and an inner cowl of said combustor.

15. The combustor dome of claim 12, wherein said second end of said combustor dome is connected to an outer liner and an outer cowl of said combustor.

16. The combustor dome of claim 12, wherein said arcuate third dome portion has a designated radius.

17. The combustor dome of claim 16, wherein said designated radius of said arcuate third dome portion is a function of a thickness for said combustor dome.

18. The combustor dome of claim 17, wherein said designated radius is at least twice the thickness of said combustor dome.

19. The combustor dome of claim 17, wherein said designated radius is approximately 3–5 times the thickness of said combustor dome.

20. The combustor dome of claim 12, wherein an opening is formed between each corrugation and said liner to permit air to flow therethrough.

21. The combustor dome of claim 12, wherein said second dome portion is connected to said liner in a position forward of said third dome portion.

* * * * *